US005516048A

United States Patent [19]

Falk

[11] Patent Number: 5,516,048

[45] Date of Patent: May 14, 1996

[54] PROCESS FOR TREATMENT OF WHOLE-WHEAT CEREALS

[75] Inventor: Otto Falk, Kremperheide, Germany

[73] Assignee: Steinmetz-Patent-Müllerei GmbH & Co. KG, Krempe, Germany

[21] Appl. No.: 244,025

[22] PCT Filed: Oct. 6, 1993

[86] PCT No.: PCT/EP93/02726

§ 371 Date: May 13, 1994

§ 102(e) Date: May 13, 1994

[87] PCT Pub. No.: WO94/08717

PCT Pub. Date: Apr. 28, 1994

[30] Foreign Application Priority Data

Oct. 17, 1992 [DE] Germany ..... 42 35 081.6

[51] Int. Cl.[6] ..... B02C 23/08; B02C 23/20

[52] U.S. Cl. ..... 241/7; 241/12

[58] Field of Search ..... 241/1, 6, 7, 12, 241/9

[56] References Cited

U.S. PATENT DOCUMENTS

| | | | |
|---|---|---|---|
| Re. 17,829 | 10/1930 | Dienst | 241/7 |
| 1,279,308 | 9/1918 | Emenegger et al. | 241/7 X |
| 1,503,423 | 7/1924 | Little . | |
| 1,740,892 | 12/1929 | Gillespie . | |
| 2,115,639 | 4/1938 | Leach . | |
| 4,196,224 | 4/1980 | Falk | 241/7 |

FOREIGN PATENT DOCUMENTS

| | | | |
|---|---|---|---|
| 373274 | 6/1990 | European Pat. Off. . | |
| 509876 | 10/1992 | European Pat. Off. . | |
| 2067956 | 8/1971 | France | 241/7 |
| 2145923 | 2/1973 | France . | |
| 400347 | 8/1924 | Germany . | |
| 2633275 | 1/1978 | Germany . | |
| 2952708 | 3/1981 | Germany . | |
| 54853 | 6/1922 | Switzerland . | |
| 463247 | 9/1968 | Switzerland . | |
| 498733 | 2/1939 | United Kingdom . | |

*Primary Examiner*—Timothy V. Eley
*Attorney, Agent, or Firm*—Lane, Aitken & McCann

[57] ABSTRACT

A process for the processing of whole-wheat cereals in which: the grains are subject to a shower wash using only little more water than is necessary to enclose the surface of the grains; counterflowing air is conducted past the grains to remove excess water; and the grains are exposed to a collision turbulence process.

6 Claims, 5 Drawing Sheets

Fig. 5
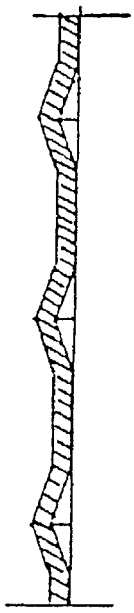
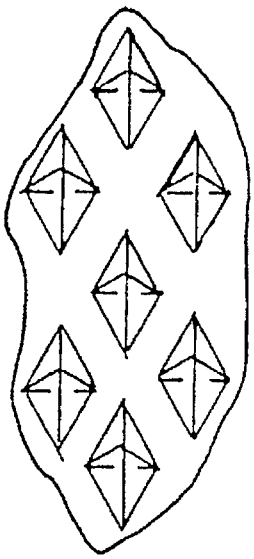
Fig. 6

PROCESS FOR TREATMENT OF WHOLE-WHEAT CEREALS

The invention relates to a process for peeling shower-washed whole-wheat cereals by means of diametral collision turbulence friction on an optimum separation line by localization of a predetermined quantity of moisture in a morphologically determined separation area between longitudinal and transverse cell layers. The process is carried out with the highest efficiency possible in reducing environmentally harmful substances, toxic agents, and problem bacteria by optimizing completely uniform surface removal and grain crease opening and cleaning with diametral collision turbulence friction of individual grains, exhaust air discharge of the peeled grain coatings, and centrifugal force conveyance of the grains. This prepares the cereals for energy saving grain grinding with a larger surface of the milling product for faster and higher absorption of water, good expansion, for a larger volume of dough and baked product, and for an improved gelatinization and efficiency of starch decomposition. From a physiological or food consumption point of view, the process achieves kinetic shortening of the endosperm cell compounds for efficiency in guiding sour dough and for a pure taste of the grain, and bread and pastry produced from the grain, with good digestibility due to hygiene and uncharged microflora of highly technological refinement with diametral collision turbulence friction.

The invention also relates to a process for intensive cleaning of grains, granulates, pulses, nuts, seeds and other grains with diametral collision turbulence friction. Preferably the invention involves peeling of shower-washed whole-wheat cereals for a quantitative completion of a technical process in substantial and material grain tissues and grain components due to a less intensive mechanical stress and damage of the grains by a peeling process and a realization of an optimum separation line by localization of the penetration depth of the water to the morphologically predetermined separation area between longitudinal and transverse cell layers. This is done by elimination of surface constraint and centering of the water in a shower wash penetrating uniformly fast over the whole hygroscopic surface of the grain. Unabsorbed moisture is centrifuged to avoid allowing it to concentrate in the crease, capillaries and deeper coating tissue with deposited dirt particles. Instead of transcontamination, the reduction of problem bacteria, environmentally harmful substances and toxic agents is achieved, and the food-physiological hygienic efficiency of the grain components is prioritized.

The diametral collision turbulence friction is realized at a high differential speed of 20–50 m/sec between two working profile disks. This achieves a lasting shortening and loosening of the genetic cell compounds of the grain endosperm for a larger product surface of the milled grains. The results are improved water absorption, swelling, elasticity, volume increase and efficiency in the microflora for the technological decomposition of the grain components in the sour dough, and for a pure taste and digestibility from a physiological or food consumption point of view, which is clearly perceptible in the milling product and in the baked product.

In order to achieve a uniform grain surface removal on the predetermined separation line between the longitudinal cell tissue layer to be removed and the transverse cell tissue layer to remain on the grain, grains prepared according to the invention are collided immediately and repeatedly in collision turbulence friction, thereby emptying the grain crease, opening it further and emptying it again. This also takes place after the coating of each grain has become more elastic and larger due to the diametral collision friction in the collision turbulence and at the working surfaces, whereby the coating separates from the grain, falls down and is aspirated with suction air already in a space between the working surfaces arranged diametrally to each other, rerouted horizontally into the aspiration ring shaft and aspirated axially. At the same time, the grains are accelerated over a path of the collision turbulence friction according to the invention from axial delivery on the working surface of the rotor with coaxially surrounding parts. The grains are accelerated by the working profile form of preferably rhombus-parallelogram pyramids on the working surfaces at different angles to an inclined plane at 0 to 180 degrees at an angle of 30 to 60 degrees by the high rotational speed of 20–50 m/sec, and the grains rebound from the axially diametral working surfaces at the same and/or a different angle. The grains also collide diametrally turbulently against other grains, and rub with more and more intensive collision turbulence friction towards the outer rims of the disks, with the aid of the rotational speed that increases with distance from the axis and differential rotational speed between the working surfaces, the distance between which decreases with distance from the axis. The peeled grains achieve a lasting shortening and loosening of the cell compounds of the endosperm for an essential energy saving in later, separate milling, and the milled products can thus absorb more water faster. The resulting doughs obtain a larger volume with higher elasticity and better swelling of the starch at baking, since more water for starch swelling is available.

Amylogram curves of peeled milled product and unpeeled milled product of the same lot show a clear volume increase of approximately 40%, an elasticity increase from AE 380 to AE 530 plus elevated Falling Number, an increase of the gelatinization temperature from 69° to 70° C., and a sensible higher absorption of water.

The efficiency of the process in reducing environmentally harmful substances, toxic agents like lead, benzpyrene and other harmful substances in the air from industrial plants and a growing number of refuse incinerators, and a radioactive charge of e.g. cesium −137 and cesium −134 indicates the food-physiological value of the process according to the invention. Its value is demonstrated advantageously by the reduction of problem bacteria in the biological guiding of sour dough, especially with whole-wheat scraps and flours. About the influence of the substrate and the temperature measurement can be said:

Comparing the distribution of yeasts and bacteria in pure sour doughs with the distribution in different spontaneous sour doughs, the conclusion is reasonable that obviously the substrate, i.e. the kind of flour or scrap used and its degree of milling, influences their proportion more than the temperature at which the spontaneous sour doughs, and probably also the pure sour doughs, are guided.

If furthermore an advantageous loosening results in better decomposition of the grain components only with pure sour dough guiding, the object of the grain surface processing with regard to its food-physiological health value can be achieved, and is more than just an intensive processing of the grain surface with the known faults of round peeling, the high water consumption and the uncontrolled attack in the hemp, or even the soaking in limy water (DE-PS 295 27 08).

Also, the germ of the whole-wheat has to be maintained, whereas in dry peeling machines it is removed.

On the other hand, drinking water should be saved and the environmental charges by reprocessing be avoided. In this context, the process according to the invention allows considerable savings.

Applications with working surfaces upon truncated cones and cylinders, chisels and peeling tools are known that often aim at removal of exactly the germ (EU-PS 39 30 97, DE-PS 26 33 273, DE-PS 27 16 637 and EP-PS 0 327 160).

An essential feature of the present invention is the centrifugation by profile elevations and/or grooves, e.g. of plane elevations and/or grooves similar to rhombus-parallelogram pyramids with angles of 20°–40°:30°–60° of length : width upon or inside working surfaces, advantageously displaced, which spin coaxially at high rotational differential speed, and on which working surfaces with corresponding design are arranged coaxially at high volume distance. The rotational differential speed is 20–60 m/sec without allowing grain breakage, with the grains on the working path starting at a release angle to an inclined plane at a semicircle up to 180° and an angle depth of 30°–60°, opposite the diametral surface profiles and working surfaces axially arranged above, rebound and collide with the grains of others in front of, above, beside and displaced working surface profiles of 2,000–6,000 pieces/$m^2$ diametrally in turbulence against each other, rub, and again are displaced by the coaxially surrounding structure elevations and/or groove by the centrifugal force, and accelerated faster with increase of the coaxial distance and conveyed to the outer rim of the ring disks.

Measurements of the impact intensity, the density, the pressure, and the angle of the different forms, number, sizes and angle incidences clearly show the efficiency with the same product and same quantity in the impact density, intensity, impact friction and use of surface.

The working surfaces not touching each other are positioned with their profiles diametral to each other and have preferably the form of a key, opposite to the growing centrifugal force generated technically at a distance from the axis that operates with higher dynamics in the collision turbulence friction for a greater pressing upon the rotor and accelerator.

The grains and coatings leaving the treatment process at the disk rim are centrifugally bound against a surrounding cylinder around the space defined by the aspiration ring shaft, its working surfaces being equipped with positive and/or negative stampings. The grains fall towards oppositely flowing air in the aspiration ring shaft and into the ring collection funnel having an asymmetric spout, the collection funnel being perforated by a centripetal cylinder around the shaft, being aspirated by suction air passing through the cylinder.

In addition, the grains can be conducted centripetally and axially to a lower rotor for post-processing and, thereby, experience a second collision turbulence friction process.

For the collision turbulence friction, according to the grain size or type, an adjustable incidence in the axial measure of the diametral working profiles is necessary to adjust regulatingly the size of the grain, the genetic grain temper and the optimum collision volume. This is achieved by a hollow shaft with a corresponding groove that axially supports the rotor processing body with the working surface in a resting position and movably during operation over the driven full shaft, by a cylinder with external threads around the centripetal full shaft receiving the support of the full shaft, and by a second, larger cylinder with internal threads, which receives the support of the hollow shaft with the rotor body, which is axially adjustable by rotation. As a result, a manual and/or automatic regulating incidence can take place that projects, depending on the charge, by means of an electronic computer, to the through-flow measuring of the shower-wash cone, to an adjustable changed nominal value and delivers automatically and regulatingly, with electronic control.

The double cylinder support is supported upon a plate with a hollow bottom and three feet in a way that, in the case of horizontal turning, the support feet with the double cylinder can be removed and mounted axially through the bottom plate, in order to change the damaged support quickly in the case of permanent operation or mass product processing.

Aspiration of the removed coatings takes place during the whole processing phase, in the space between the working surfaces, at the rerouting at the collision-brake-rerouting rings at the space around the outer disk rim, and when falling off in an aspiration shaft with air flowing from below in the opposite direction. Aspiration also takes place through the cylinder penetrating the spout inclination of the ring collection funnel, axially around the double shaft and the cylinder supports where the removed coatings are aspirated axially, rerouted at the rotor working body, and discharged upwards into the aspiration ring shaft and at three points through the cover, according to a 3/3 division of the telescopic and adjustable rigid working surfaces, including the aspiration ring shaft in a 3/3 division.

In an execution of the machine with one or more post-processing bodies, an aspiration ring shaft each with a reducing ring width is arranged outwards and combined above to a ring. So, in the sequence from top to bottom of the axially arranged processing disks, the cross-section of the collision turbulence friction disks through the additional aspiration shaft around the aspiration ring shaft increases, and, also in case of preceding supply upon the processing bodies, only one aspiration ring shaft each conducts the whole-wheat grains to the asymmetric spout of the ring collection funnel.

The efficiency of the collision turbulence friction in maintaining the peeling of the coating at the predetermined separation line, as well as for the completeness of peeling, is especially high in case of special preparation, if a specific admission with a certain water quantity per time unit can be assured.

After the necessary quantity of water for the technological treatment process of the admission of the grain surface had been found, the centrifugation quantity could be reduced to a minimum.

The very narrow tolerance of the specific technological process in the collection and admission of the grains was resolved technically by the dosage of the delivery quantity upon the tip of a cone adjustable in height, lastingly distributed axially around the cone tip by a cylinder with a centripetally incorporated funnel, and by supplying impulses, from a pressure cell or balance under the cone suspension that is automatically adjustable in elevation, to an electronic computer outside that projecting to the changeable nominal value of 3% of the measured grain quantity doses the respective quantity of water over an automatic through-flow quantity control. Over the spray head underneath the cone, water is admitted centrally upon the grain surface of the centripetally formed diametrical grain fog, that falls into the spout of the surrounding funnel and subsequently into the inlet nipple of the axially inclined shower-washing centrifuge. Single paddles on a shaft in a cylindrical screen with radially surrounding screen slots of 1–1.5 ×20–39 mm centrifuge loose grain surface water and dissolved dirt into a surrounding tank and conduct it directly from the diametral outlet nipple to the collision turbulence friction process.

A pressure cell balance in the suspension of the inlet-regulating delivery cone determines the quantity of grain which passed and transmits the corresponding values to an electronic computer outside the plant that compares the measured values with a nominal value and projects whether the value is within a maximum tolerance or has to be adjusted. The pressure call balance executes the corresponding orders by itself, if e.g. the penetration depth of the cone tip into the delivery cylinder is given by a signal to the delivery motor, and determines the predictably necessary change of the path to plus or minus.

In this case, the order is transmitted to a braking motor with a pinion inside the grooved, central, axially vertical round shaft that lowers or raises the shaft supporting the cone, thereby increasing or reducing the passage quantity.

The pressure cell balance, which is centripetally supported horizontally on a cross-fitting in the funnel, registers the passage values from the cylinder in which the servo-motor changes the shaft thereby adjusting the penetration depth.

Pressure rolls on flexible arms hold the cone from inside in vertical balance from the cylinder upon the electronic pressure cell balance that transmits the determined data to the computer outside the aggregate, over a cable through one of the empty tubes of the cross-fitting, and in this way changes the orders to the servo-motor that changes the passage by acceleration and braking.

According to grain type and specific presupposition in the computer, it projects at intervals of 5–30 sec and adjusts accordingly.

Simultaneously, the water dosage is controlled according to the product indication number over an electronic regulation valve from outside, like also the diametral distance of the working surfaces over the product indication number and the rotational speed of the mounted driving vario-motor.

As a total result arise: 1) the greatest efficiency possible in reduction of environmentally harmful substances, toxic agents and problem bacteria by optimization of the uniform surface removal on a predetermined morphological separation zone and opening of the grain crease with collision cleaning in single grain collision turbulence friction with centrifugal conveyance and exhaust air discharge of coatings and dirt of the shower-washed grain according to the invention with uniform admission of the grain surface and localization of the penetration depth of the water into the longitudinal cell layer and centrifugation of loose excess water and dissolved surface dirt with a total use of water of 3%; 2) kinetic shortening efficiency of the endosperm cell compounds in diametral collision turbulence friction without damage of the whole-wheat product and full-worth product and without processing and conveying tools with efficiency in the microflora hygiene for the specific biological guiding of the sour dough for efficiency in the decomposition of the grain components, with a pure taste and good digestibility that is also given to the better swelling and the decomposition of the starch since by the peeling and shortening with diametral collision turbulence friction, a higher water absorption of 6–12%, a larger product volume of 40%, faster water absorption of the whole-wheat of 15–18 times, and higher milling for the food-physiological maximum value of 8–15% is achieved technologically; 3) technically, a new quantity adjustment and water application upon the single grain surface in the grain fog formed centripetally diametrally, centrifugally from seven nozzles of water particles centered by a spray head, and localization of the penetration depth and diametral collision turbulence friction through working surface disks with a high differential speed of 20–50 m/sec and a large number of working profiles of 2,000–6,000 pieces/$m^2$ in rhombus-parallelogram pyramid form, in positive and/or negative stampings, also on the surrounding collision braking ring in the aspiration ring shaft with exhaust air discharge and air aspiration through a cylinder constructed centripetally to the spout and coaxially around the driving shaft and the double cylinder supports, as well as the grain inlet; and 4) support of the centrifugal conveying (in the diametral collision turbulence friction) at a diametral distance of the working profile disks that can also be formed like a key, and technical consideration of maintenance, repair, product change, spare parts obtaining and costs, as well as the personnel necessary for execution in the 3/3 drawer access of the working surface profile and collision braking ring, double cylinder support change, mounting drive under the bottom and fully automatic electronic regulation of the grain determination, assignment, water dosage, diametral working profile incidence, rotational speed regulation of the vario-motor, and monitoring of the water centrifugation.

The process features of the present invention are that the grains are subject to a shower wash in which only little more water is placed at disposal than is necessary to cover or enclose the surface of the grains. Flowing opposite to the water, an airflow is conducted past the grains, eliminating excess water. The preprocessed grains are exposed to collision turbulence processes during which they are conducted into a chamber with fixed and rotating working surfaces, with the working surfaces being provided with projections and/or grooves that diametrally turbulently accelerate the colliding grains.

The invention is exemplified below by the Figures:

BRIEF DESCRIPTION OF THE DRAWINGS

FIG. 3 shows an arrangement provided with screening units, especially a surrounding cylindrical-shaped screen with screen slots and the like.

FIG. 5 and 6 show examples for the design of the working surfaces of the working bodies, in sectional view and top view.

DETAILED DESCRIPTION OF THE INVENTION

Figure 1:
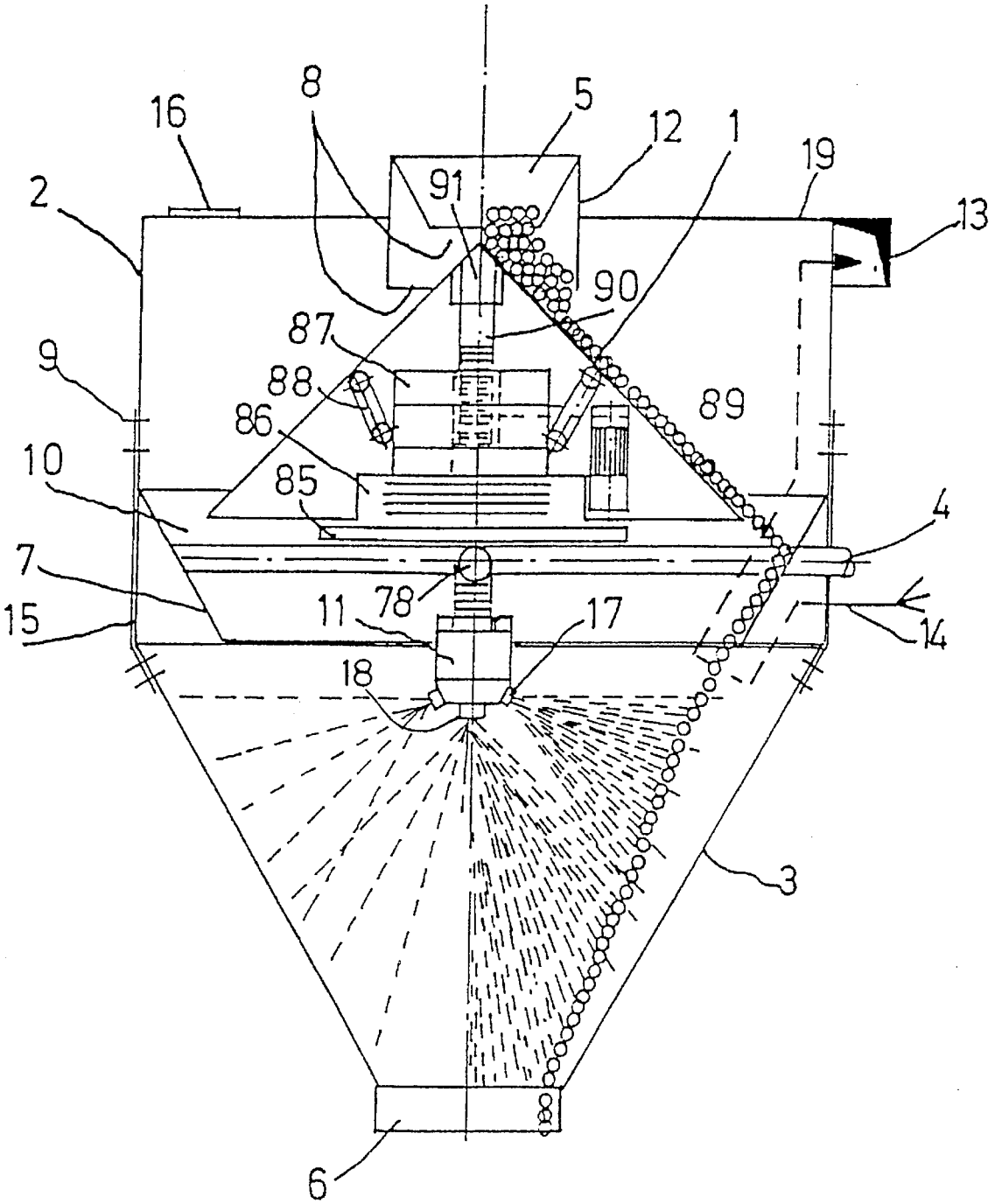
FIG. 1 shows a covered cylinder and a funnel that hangs from the cylinder at an axial distance by means of hanging ties.

FIG. 1 shows a covered cylinder 2 and a funnel 3 that hangs from cylinder 2 at an axial distance by means of hanging ties 15.

Upon the cover 19 of the cylinder 2, a funnel 5 is arranged concentrically above the tip of concentrical cone 1. The top of the cone 1 is adjustable through the distance 8 in an axial direction by an elevation adjustment of a cone suspension 9. Through a control window 16, the grain flow inside the cylinder 2 is visible.

The cone 1 ends concentrically at its bottom in a larger funnel 7 that is suspended underneath the cylinder 2. A tube 4 is led laterally into the larger funnel 7 to supply water to a spray head 11 with six nozzles 17 that are displaced horizontally at 60° increments around the spray head and directed towards the funnel 3, which is positioned concentrically with the funnel 7. The spray head 11 is furthermore provided with a central lower nozzle 18 so that a fog forming a hollow cone is sprayed upon the grains completely from the inside.

As shown by the arrow 14, air can reach a suction joint 13 through the hollow cone fog of the grains and through an annular space or a ring slot 10 between the funnel 7 and the cone 1.

The tube 4 is formed by two empty tubes extending towards a tube ring 78 resting diametrally upon the walls of the funnel 7. The tube ring 78 serves as a support 85 for a passage balance 86. A cylinder 87 effects upon inner walls of the cone 1 over movable backing roll arms 88 to control the penetration depth of a shaft 90 over a servo-motor 89.

Three support feet 45 and 59 (FIG. 2) that are each divided longitudinally by a double flange 58 serve as a support of a vertical shaft 21.

Working bodies 35 and inclined cone surfaces 33 are arranged upon the shaft 21 or a hollow shaft 40 as rotors with working surfaces.

Collision cylinders 38 and 28 are provided to brake and reroute the grains and to conduct them to a collection funnel 43, opposite to oncoming suction air. The collection funnel is provided with a spout 54.

The outlet slope of the collection funnel 43 is interrupted in the area of the shaft 21 and the hollow shaft 40 by a cylinder 50 arranged there. A slider 73 conducts the grains around the cylinder 50, through which the suction air is aspirated and discharged through an air suction joint 24 towards the outside.

With an upper support 42, the shaft 21 is supported upon a machine cover 44. Girder sections 29 are provided to absorb dynamic oscillation and bear the weight of the shaft 21. A double cylinder support serves for rerouting the forces to a bottom plate 51 reinforced by a support 39.

Under the bottom plate 51, a geared engine 20/57 for the shaft 21 is arranged.

The preprocessed grains in the funnel 3 (FIG. 1) are conducted to a working surface of the working body 35 through an inlet 49 (FIG. 2), an inlet funnel 48, and a cylinder 32. The preprocessing is a kind of shower wash in which the grain surface absorbs moisture and swells up.

In a chamber between a fixed working surface 36 and a working surface of the quickly rotating working body 35, considerable turbulence of the grain flow reaching this chamber occurs. This is not only due to the considerable differential speed of the two working surfaces but also, among other factors, to the design of the working surfaces of the working bodies 35 and 36, the centrifugal forces, and gravity, as well as to the reciprocal effects of the collisions of single grains. The working surface of the working body 35 is formed with a plurality of axial projections and/or grooves, preferably in the form of low pyramids that virtually "launch" the colliding grains with a distinct axial component of movement, so that their grain crease is opened and a cleaning effect achieved. By "pyramid" is meant all possible geometrical forms with an extension tapering off from a bottom area to a tip, including irregular forms that may be distributed nonuniformly upon the working surfaces.

This processing results in the possibility of removal or peeling of the outer wood fiber coating of the grain, the epidermis with beard, down to a predetermined separation zone, which up to now was not achievable with known grain cleaning processes. The special advantages of this processing — the so-called shower wash with subsequent removal of the outer coating by diametral collision turbulence — results in a relatively large surface for the milling product, lower energy consumption during milling, and additionally a higher degree of milling. The milling product from grain processed according to the present invention can absorb a larger quantity of water and result hence in a higher volume increase for whole-wheat doughs in which the product is used. Furthermore, the above described pre-processing can avoid environmentally harmful substances, toxic agents and problem bacteria, that are often accumulated in large extent upon the epidermis and in the beard, from getting into the dough, and can facilitate a specific guiding of the sour dough, with the grain components that are important for digestibility and consumption from a food-physiological aspect being decomposed better.

The above described process of collision turbulence also takes place in the area between the fixed working surface 34 and the working surface of the working body 33, which is also rotated at high speed.

According to the preferred embodiment of the present invention, it is possible to supply the grains leaving the funnel 3, not directly to the inlet 49, but to an intermediate step in which the surface water is eliminated from the grains. This surface water mostly contains a considerable part of the dissolved dirt. Thus, the final product, the grain to be milled, meets even higher requirements if this surface water is eliminated before the treatment of the grain by the turbulence effect, and dissolved dirt does not move into the grain crease, transcontaminating it.

Figure 3:
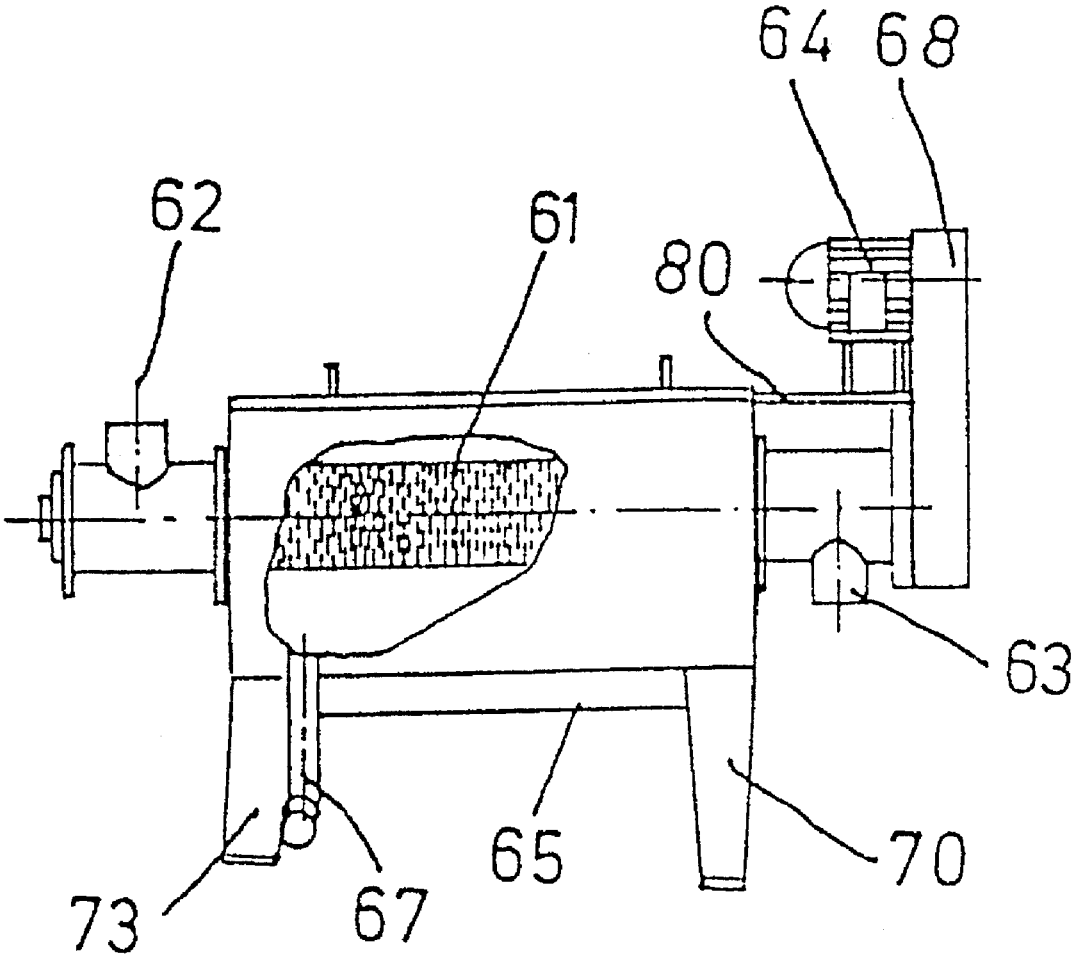

For the intermediate step, screen units, especially surrounding cylindrical-shaped screens with screen slots and the like, are possible. A unit of this kind is shown in FIG. 3. A steel tank 65 with a collection trough bottom is positioned with a horizontal inclination and the tank sloping axially upon shorter feet 73 and higher feet 70. Cylinder stubs on a front side of the tank 65 provide an inlet tube 62 on the lower front side and, diametrally opposite, an outlet tube 63 on the higher part.

A drive 68 with a motor 64 rests upon a pipe bridge 80. Loose surface water and dissolved dirt are centrifuged through radially surrounding slots of a cylindrical-shaped screen 61 into the tank 65 and can be discharged at the lowest point through a drain 67.

Figure 2:
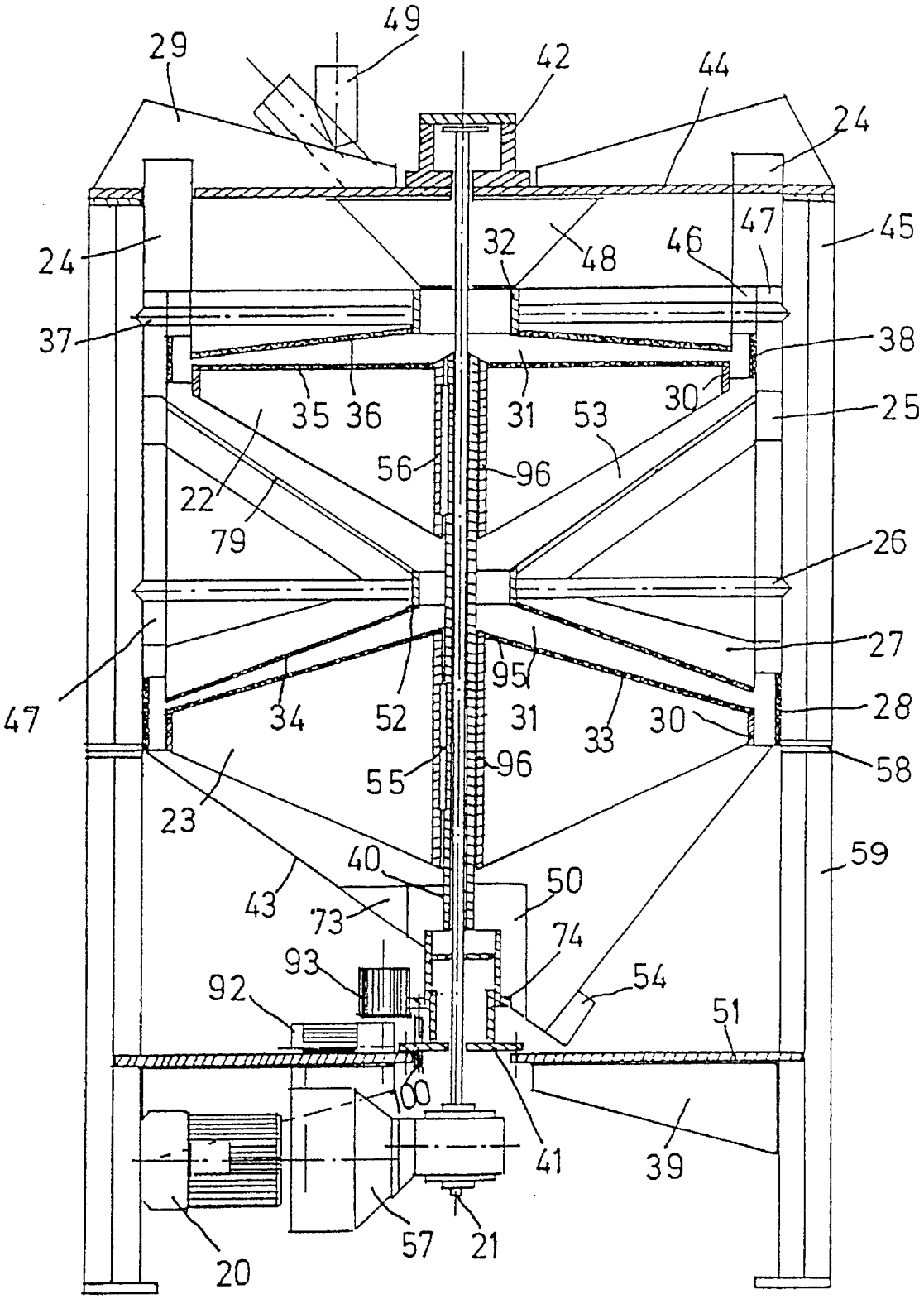
FIG. 2 shows a collision turbulence unit according to the present invention.
Figure 4:
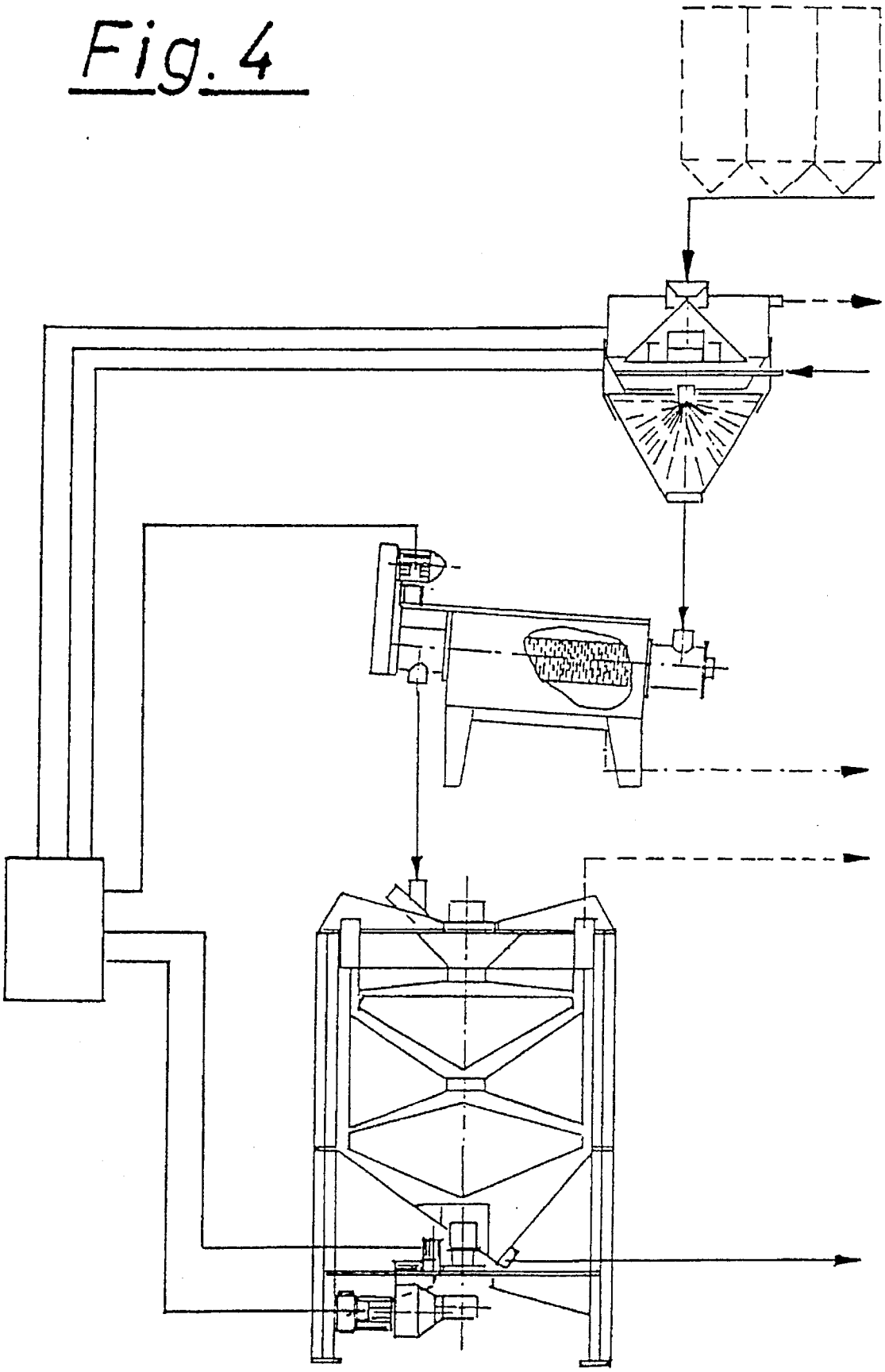
FIG. 4 shows the arrangement of the units described in FIG. 1 to FIG. 3.

FIG. 4 shows an arrangement of the already described units, the shower-wash unit according to FIG. 1, the screen unit according to FIG. 3, and the collision turbulence unit according to FIG. 2, as well as an electronic data processing unit that charges the individual units according to a program and receives the necessary process data.

FIGS. 5 and 6 show examples of the design of the working surfaces of the working bodies 35 and 36, in sectional view and top view. These are the prismshaped elevations projecting outwards that exercise the above described effects upon the grains.

I claim:

1. A process for removing an outer coating of grains of whole-wheat cereals, comprising:

shower washing the grains to enclose the surface of the grains with water and removing excess water from the grains, whereby a predetermined quantity of moisture is absorbed in the grains in a morphologically determined separation zone between longitudinal and transverse cell layers of the grains; and subjecting the grains to diametral collision turbulence to remove the outer coatings by conducting the grains into engagement with fixed working surface and with rotating working surfaces, the fixed working surfaces and the rotating surfaces defining a chamber, and diametrally accelerating the grains turbulently and into diametral collisions with one another through the use of formations on the fixed and rotating working surfaces.

2. The process of claim 1, further comprising conducting a flow of air past the grains to take away the removed outer coatings.

3. The process of claim 1, wherein the grains are diametrally accelerated by projections and/or grooves on the working surfaces.

4. The process of claim 1, wherein the step of shower washing comprising shower washing the grains with only slightly more water than is necessary to enclose the surface of the grains.

5. The process of claim 4, further comprising conducting a flow of air past the grains to take away the removed outer coatings.

6. The process of claim 4, wherein the grains are diametrally accelerated by projections and/or grooves on the working surfaces.

* * * * *

UNITED STATES PATENT AND TRADEMARK OFFICE

CERTIFICATE OF CORRECTION

PATENT NO. : 5,516,048

DATED : May 14, 1996

INVENTOR(S) : OTTO FALK

It is certified that error appears in the above-indentified patent and that said Letters Patent is hereby corrected as shown below:

Column 9, line 1, "surface" should be --surfaces--.

Signed and Sealed this

Tenth Day of September, 1996

Bruce Lehman

*Attest:*

BRUCE LEHMAN

*Attesting Officer*

*Commissioner of Patents and Trademarks*